US006629885B1

(12) United States Patent
Tsuruda et al.

(10) Patent No.: US 6,629,885 B1
(45) Date of Patent: Oct. 7, 2003

(54) COIN SORTING APPARATUS AND COIN HANDLING MACHINE USING THE SAME

(75) Inventors: Mitsumasa Tsuruda, Saitama (JP); Yuji Takahashi, Saitama (JP)

(73) Assignee: Laurel Bank Machines Co., Ltd., Tokyo (JP)

( * ) Notice: Subject to any disclaimer, the term of this patent is extended or adjusted under 35 U.S.C. 154(b) by 0 days.

(21) Appl. No.: 09/717,629

(22) Filed: Nov. 21, 2000

(30) Foreign Application Priority Data

Dec. 2, 1999 (JP) ..... 11-342759

(51) Int. Cl.[7] ..... G07D 3/00; G07D 9/06

(52) U.S. Cl. ..... 453/3; 453/59; 453/61; 453/56

(58) Field of Search ..... 453/3, 4, 59, 61, 453/56; 194/334, 344

(56) References Cited

U.S. PATENT DOCUMENTS

| | | | | |
|---|---|---|---|---|
| 4,920,730 A | * | 5/1990 | Inoue et al. | 453/61 |
| 4,992,075 A | * | 2/1991 | Miyamoto | 453/61 |
| 5,207,611 A | | 5/1993 | Ueda et al. | |
| 5,910,044 A | * | 6/1999 | Luciano, et al. | 453/32 |
| 6,431,342 B1 | * | 8/2002 | Schwartz | 194/346 |

FOREIGN PATENT DOCUMENTS

| | | | | |
|---|---|---|---|---|
| EP | 481699 A2 | * | 4/1992 | G07F/1/02 |
| JP | 5-2680 A | * | 1/1993 | G07F/1/04 |
| JP | 2518724 | | 5/1996 | |

* cited by examiner

*Primary Examiner*—Donald P. Walsh
(74) *Attorney, Agent, or Firm*—Cohen, Pontani, Lieberman & Pavane

(57) ABSTRACT

A coin sorting apparatus for a coin handling machine includes a coin sorting passage extending substantially one-dimensionally and having transporting belt means for conveying coins, and a denomination discriminator provided in the coin sorting passage for discriminating the denominations of coins, wherein the coin sorting passage is bifurcated at a downstream portion thereof into a coin selecting passage for leading coins to be sorted therethrough and a coin collecting passage for leading coins other than those to be sorted therethrough, the coin sorting apparatus further including a gate member provided at the portion where the coin sorting passage is bifurcated into the coin selecting passage and the coin collecting passage for selectively leading coins into the coin selecting passage or the coin collecting passage in accordance with results of discrimination made by the denomination discriminator. According to the thus constituted coin sorting apparatus, it is possible to improve coin handling efficiency without size increase of the coin sorting apparatus.

20 Claims, 6 Drawing Sheets

COIN SORTING APPARATUS AND COIN HANDLING MACHINE USING THE SAME

BACKGROUND OF THE INVENTION

The present invention relates to a coin sorting apparatus and a coin handling machine using the same and, particularly, to such an apparatus which improves coin handling efficiency without size increase and a coin handling machine using the same.

DESCRIPTION OF THE PRIOR ART

Japanese Patent No. 2518724 discloses a coin sorting apparatus comprising coin discriminating means for discriminating whether or not a coin is acceptable and the denomination of the coin, a transporting belt for conveying coins along a reference rail in a coin conveying passage, a coin sorting opening formed in the coin conveying passage at a predetermined distance from the reference rail and adapted for causing coins to fall therein, and coin conveying direction turning means having a semicircular cross section, wherein when a coin of a predetermined denomination is detected by the coin discriminating means, the coin conveying direction turning means is located so that the flat surface portion thereof is aligned with the reference rail, thereby conveying the coin along the reference rail, and when a coin of a denomination other than a predetermined one is detected by the coin discriminating means, the coin conveying direction turning means is turned so that the cylindrical surface portion thereof projects into the coin conveying passage and abuts against the coin of a denomination other than a predetermined one, thereby turning the conveying direction of the coin so that the coin is led to the coin sorting opening and falls therein, whereby coins of a predetermined denomination are sorted.

However, since this coin sorting apparatus is constituted so as to turn the direction of a coin being conveyed while it is held between the transporting belt and the surface of the coin conveying passage and lead the coin to the coin sorting opening so that it freely falls therein, thereby sorting coins of a predetermined denomination from coin of other denominations, it is indispensable to increase the length of the coin sorting opening in the coin conveying direction in order to make coins of the predetermined denomination reliably fall in the coin sorting opening and, therefore, the coin sorting apparatus inevitable becomes large.

In particular, in the case where the conveying speed of coins is increased for improving coin handling efficiency, the coin sorting opening has to be formed much longer in the coin conveying direction. Since the coin sorting apparatus therefore becomes even larger and the size of the coin handling machine also increases to an unacceptable degree, a solution for avoiding size increase is necessary.

SUMMARY OF THE INVENTION

It is therefore an object of the present invention to provide a compact coin sorting apparatus for a coin handling machine.

It is another object of the present invention to provide a coin sorting apparatus for a coin handling machine, which can improve coin handling efficiency without size increase.

It is a further object of the present invention to provide a coin handling machine which can improve coin handling efficiency without size increase.

The above other objects of the present invention can be accomplished by a coin sorting apparatus for a coin handling machine including a coin sorting passage extending substantially one-dimensionally and having transporting belt means for conveying coins, and denomination discriminating means provided in the coin sorting passage for discriminating the denominations of coins, wherein the coin sorting passage is bifurcated at a downstream portion thereof into a coin selecting passage for leading coins to be sorted therethrough and a coin collecting passage for leading coins other than those to be sorted therethrough, the coin sorting apparatus further including gate means provided at the portion where the coin sorting passage is bifurcated into the coin selecting passage and the coin collecting passage for selectively leading coins into the coin selecting passage or the coin collecting passage in accordance with results of discrimination made by the denomination discriminating means.

According to the present invention, the coin sorting passage is bifurcated at a downstream portion thereof into a coin selecting passage for leading coins to be sorted therethrough and a coin collecting passage for leading coins other than those to be sorted therethrough and gate means is provided at the portion where the coin sorting passage is bifurcated into the coin selecting passage and the coin collecting passage for selectively leading coins into the coin selecting passage or the coin collecting passage in accordance with results of discrimination made by the denomination discriminating means. Therefore, since coins can be forcibly led by the gate means into the coin selecting passage or the coin collecting passage, it is possible to shorten the length of the coin sorting passage in comparison with a conventional coin sorting apparatus in which coins are sorted by freely dropping coins other than those to be sorted into a coin sorting opening. Moreover, even when the conveying speed of coins is increased for improving coin handling efficiency, it is still possible to prevent size increase of the coin sorting apparatus and, accordingly, of the coin handling machine, because there is no need to excessively increase the length of the coin sorting passage.

In a preferred aspect of the present invention, the gate means is constituted so that when coins are to be led into the coin selecting passage, the gate means prevents coins from advancing into the coin collecting passage and that when coins are to be led into the coin collecting passage, it prevents coins from advancing into the coin selecting passage.

In a further preferred aspect of the present invention, the gate means is formed by a rod member which is mounted on a shaft provided at the bifurcated portion so as to be swingable about the shaft and is constituted so that when coins are to be led into the coin selecting passage, it is swung into the coin collecting passage, thereby preventing the coins from advancing into the coin collecting passage and that when coins are to be led into the coin collecting passage, it is swung in the coin selecting passage, thereby preventing the coins from advancing into the coin selecting passage.

According to this preferred aspect of the present invention, coins can be forcibly led by the gate means into the coin selecting passage or the coin collecting passage merely by swinging the rodlike gate means about the shaft provided at the bifurcated portion in accordance with the results of the discrimination made by the denomination discriminating means. Consequently, it is possible to shorten the length of the coin sorting passage with a simple structure in comparison with a conventional coin sorting apparatus in which coins are sorted by freely dropping coins other than those to be sorted into a coin sorting opening. Moreover, even when the conveying speed of coins is increased for improving coin handling efficiency, it is still possible to prevent size increase of the coin sorting apparatus and, accordingly, of the coin handling machine, because there is no need to excessively increase the length of the coin sorting passage.

In a further preferred aspect of the present invention, the gate means is mounted on the shaft in the vicinity of an end portion thereof and is swingable from an upstream side of the coin collecting passage and the coin selecting passage toward a lower side thereof so as to cross a plane which is parallel to a longitudinal direction of the coin sorting passage and includes the shaft.

According to this preferred aspect of the present invention, since the rod-like gate means is mounted on the shaft in the vicinity of an end portion thereof and is swingable from an upstream side of the coin collecting passage and the coin selecting passage toward a lower side thereof so as to cross a plane which is parallel to a longitudinal direction of the coin sorting passage and includes the shaft, even if the actuation of the gate means is delayed for some reason, the gate means can be quickly located in the coin collecting passage or the coin selecting passage, thereby preventing coins from advancing into the coin collecting passage or the coin selecting passage and sorting coins in a desired manner.

In a further preferred aspect of the present invention, the gate means is mounted on the shaft at a substantially central portion thereof and is swingable from an upstream side of the coin collecting passage and the coin selecting passage toward a lower side thereof so as to cross a plane which is parallel to a longitudinal direction of the coin sorting passage and includes the shaft.

According to this preferred aspect of the present invention, since the rod-like gate means is mounted on the shaft at a substantially central portion thereof and is swingable from an upstream side of the coin collecting passage and the coin selecting passage toward a lower side thereof so as to cross a plane which is parallel to a longitudinal direction of the coin sorting passage and includes the shaft, even if the actuation of the gate means is delayed for some reasons, coins erroneously fed into the coin collecting passage or the coin selecting passage can be pushed back by the gate means, thereby sorting coins in a desired manner.

In another preferred aspect of the present invention, the coin sorting apparatus further includes a first opening provided at an inlet portion of the coin collecting passage and a second opening provided at an inlet portion of the coin selecting passage and the gate means includes a first gate member adapted to project into the coin collecting passage through the first opening and retract below a position where it is flush with an upper surface of the coin collecting passage and a second gate member adapted to project into the coin selecting passage through the second opening and retract below a position where it is flush with an upper surface of the coin selecting passage.

According to this preferred aspect of the present invention, coins can be forcibly and selectively led into the coin selecting passage or the coin collecting passage by actuating the first gate member when the coins are to be led into the coin selecting passage and actuating the second gate member when the coins are to be led into the coin collecting passage. As a consequence, it is possible to shorten the length of the coin sorting passage with a simple structure in comparison with a conventional coin sorting apparatus in which coins are sorted by freely dropping coins other than those to be sorted into a coin sorting opening. Moreover, even when the conveying speed of coins is increased for improving coin handling efficiency, it is still possible to prevent size increase of the coin sorting apparatus and, accordingly, of the coin handling machine, because there is no need to excessively increase the length of the coin sorting passage.

In a further preferred aspect of the present invention, each of the first gate member and the second gate member is formed by a plate-like member.

The above and other objects of the present invention can be also accomplished by a coin handling machine provided with the above defined coin sorting apparatus.

According to the present invention, the coin handling machine is provided with a coin sorting apparatus which can shorten the length of the coin sorting passage. Therefore, even when the conveying speed of coins is increased for improving coin handling efficiency, it is still possible to prevent size increase of the coin sorting apparatus and, in turn, to obtain a coin handling machine of improving coin handling efficiency which is not increased in size.

In a preferred aspect of the present invention, the coin handling machine further includes a coin sorting chute connected to the coin selecting passage and a coin collecting chute connected to the coin collecting passage.

In another preferred aspect of the present invention, the coin handling machine further includes coin stacking means provided below a downstream portion of the coin selecting passage for stacking coins and coin wrapping means provided below the coin stacking means for wrapping the coins stacked by the coin stacking means.

In a further preferred aspect of the present invention, the coin handling machine further includes sensor means provided in the coin selecting passage for detecting coins.

The above and other objects and features of the present invention will become apparent from the following description made with reference to the accompanying drawings.

DESCRIPTION OF THE PREFERRED EMBODIMENT

Figure 1:
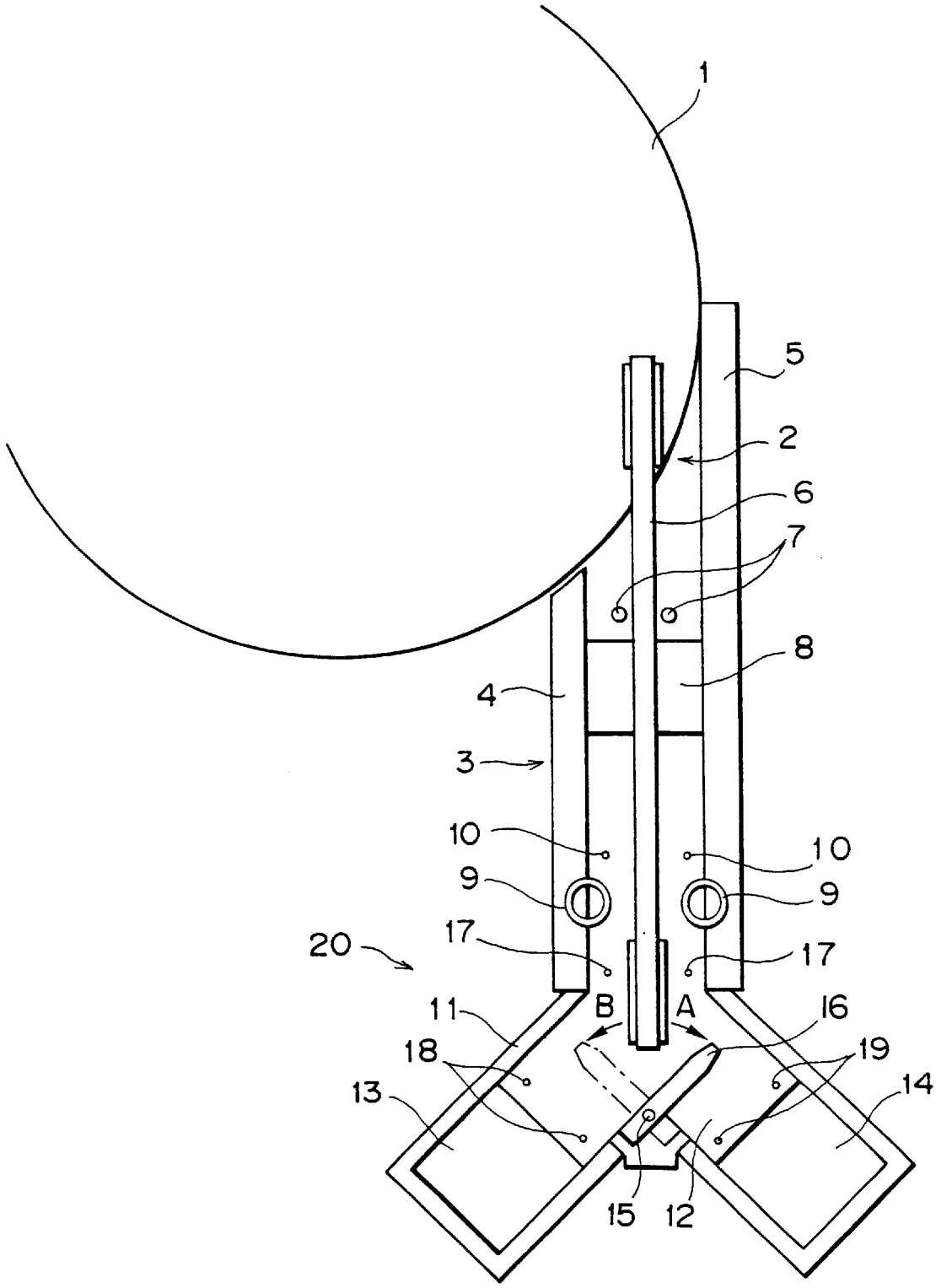
FIG. 1 is a schematic plan view showing a coin handling machine provided with a coin sorting apparatus which is a preferred embodiment of the present invention.

As shown in FIG. 1, a coin handling machine includes a rotatable disk 1 and coins deposited into the coin handling machine are conveyed by a transporting belt (not shown) onto the rotatable disk 1. As well known in the art, the peripheral portion of the rotatable disk 1 is formed with an annular guide member (not shown) and a coin sorting passage 3 is connected to an opening 2 of the annular guide member. The opening 2 of the annular guide member is formed with a slot (not shown) having a clearance greater than the thickness of the thickest coin among coins to be handled and smaller than double the thickness of the thinnest coin to be handled.

The coin sorting passage 3 is provided with a pair of guide members 4, 5 and a transporting belt 6 for conveying coins while it presses them onto the upper surface of the coin sorting passage 3. A magnetic sensor 7 is further provided for detecting magnetic properties of each coin conveyed along the coin sorting passage 3. The guide member 5 is slidable with respect to the facing guide member 4 and the width of the coin sorting passage 3 can be adjusted by sliding the guide member 5 in accordance with the denomination of coins to be handled. In this embodiment, the distance between the pair of guide members 4, 5, namely, the width of the coin sorting passage 3 is adjusted in order to simultaneously handle coins of various denominations so that the largest coins among coins to be handled can be conveyed.

In the coin sorting passage 3 downstream of the magnetic sensor 7, a surface pattern sensor 8 is provided for detecting the pattern of the lower surfaces of coins and a pair of stopper members 9, 9 are provided downstream of the surface pattern sensor 8 for preventing the following coin from being conveyed downstream when the number of coins to be sorted has reached a predetermined number. Each of the stopper members 9, 9 has a semi-cylindrical shape and is constituted to be rotatable about a vertical shaft. Each of the stopper members 9, 9 is usually located at a position where the flat-plane like side surface portion thereof is flush with the inner surface of the guide member 4 and only when the following coin is to be prevented from being conveyed downstream, the stopper member 9 is rotated about the vertical shaft so that the cylindrical side surface portion thereof projects into the coin sorting passage 3, thereby stopping the following coin. In the coin sorting passage 3 immediately upstream of the pair of stopper members 9, 9, a pair of sensors 10, 10 are provided so that when the pair of sensors 10, 10 detect the following coin to be prevented from being conveyed, the pair of stopper members 9, 9 are actuated.

The coin sorting passage 3 is bifurcated into a coin selecting passage 11 and a coin collecting passage 12 downstream of the pair of stopper members 9, 9. The coin selecting passage 11 is connected to a coin sorting chute 13 and the coin collecting passage 12 is connected to a coin collecting chute 14.

At the portion where the coin selecting passage 11 and the coin collecting passage 12 bifurcate, a rod-like gate member 16 is provided to be swingable about a vertical shaft 15. The gate member 16 is controlled to be swung by a control unit (not shown) based on the results of detection made by the magnetic sensor 7 and the surface pattern sensor 8 so that only coins of a predetermined denomination are led into the coin selecting passage 11 and coins of other denominations are led into the coin collecting passage 12. The gate member 16 is mounted on the vertical shaft 15 in the vicinity of the end portion thereof and is constituted so as to be swingable about the vertical shaft 15 over 90 degrees so that it crosses a plane which is parallel to the longitudinal direction of the coin sorting passage 3 and includes the vertical shaft 15. In this embodiment, when a coin is to be led into the coin selecting passage 11, the gate member 16 is swung in the direction as indicated by an arrow A in FIG. 1 so as to cross the plane which is parallel to the longitudinal direction of the coin sorting passage 3 and includes the vertical shaft 15 to a first sorting position indicated by a solid line so that not less than 70% of the coin collecting passage 12 in the widthwise direction thereof can be closed. On the other hand, when a coin is to be led into the coin collecting passage 12, the gate member 16 is swung in the direction as indicated by an arrow B in FIG. 1 so as to cross the plane which is parallel to the longitudinal direction of the coin sorting passage 3 and includes the vertical shaft 15 to a second sorting position indicated by a broken line so that not less than 70% of the coin sorting passage 12 in the widthwise direction thereof can be closed.

Upstream of the bifurcating portion of the coin selecting passage 11 and the coin collecting passage 12, a pair of sensors 17, 17 are provided and when the pair of sensors 17, 17 detect a coin, the gate member 16 is driven by the control unit so that the coin detected by the pair of sensors 17, 17 can selectively be led to the coin selecting passage 11 or the coin collecting passage 12.

In the coin selecting passage 11 and the coin collecting passage 12, counting sensors 18, 19 are provided so that the number of coins fed into the coin selecting passage 11 are counted by the counting sensor 18 and the number of coins fed into the coin collecting passage 12 are counted by the counting sensor 19.

In this embodiment, a coin sorting apparatus is constituted by the coin selecting passage 11, the coin collecting passage 12, the gate member 16 and the pair of sensors 17, 17.

Figure 2:
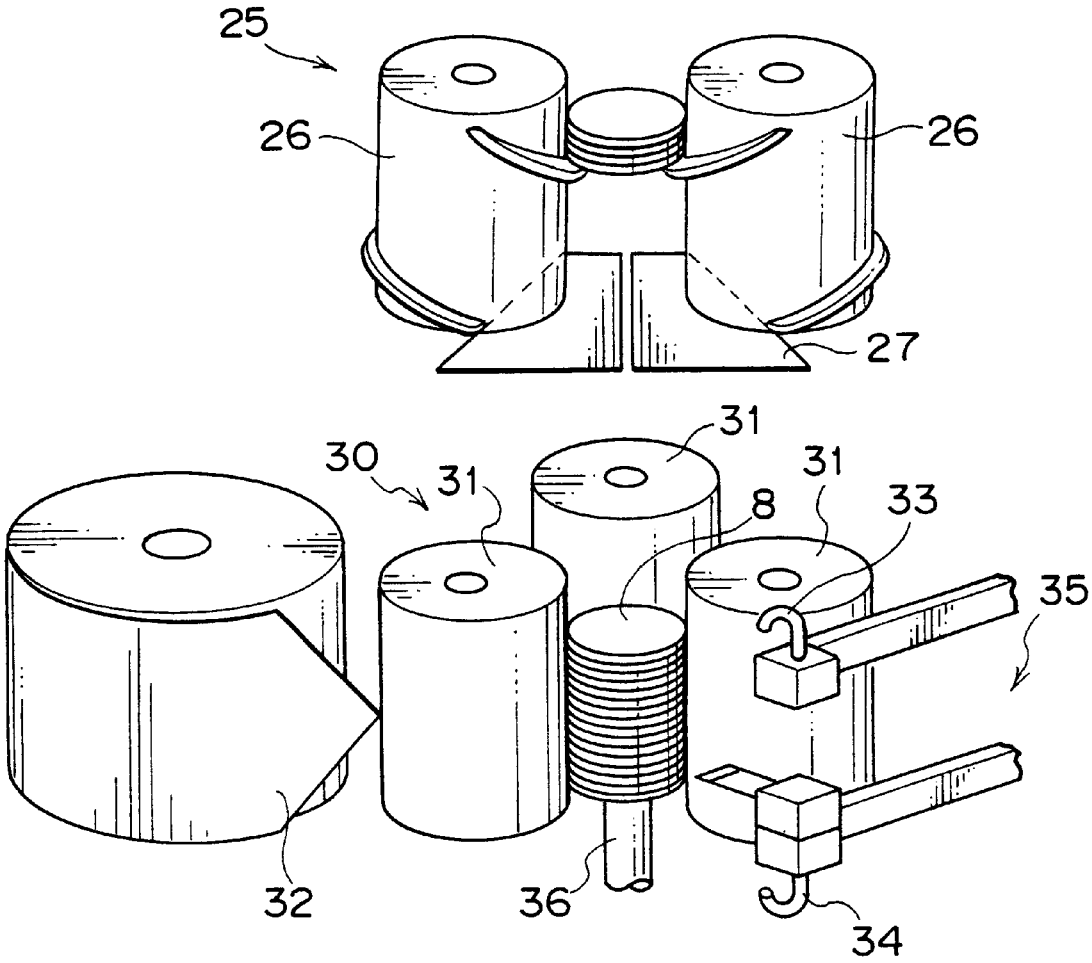
FIG. 2 is a schematic perspective view showing a coin stacking mechanism and a coin wrapping mechanism provided below a coin sorting chute.

FIG. 2 is a schematic perspective view showing a coin stacking mechanism 25 and a coin wrapping mechanism 30 provided below the coin sorting chute 13.

As shown in FIG. 2, a coin stacking mechanism 25 including a pair of stacking drums 26, 26 is provided below the coin sorting chute 13 connected to the coin selecting passage 11. As well known in the art, coins fed out from the coin sorting chute 13 are stacked between a pair of stacking drums 26, 26 and, then placed on a shutter 27.

As shown in FIG. 2, a coin wrapping mechanism 30 is provided below the shutter 27 of the coin stacking mechanism 25. The coin wrapping mechanism 30 includes three wrapping rollers 31, 31, 31, a wrapping paper roll 32, a crimping mechanism 35 having an upper crimp claw 33 and a lower crimp claw 34, and a coin support post 36 for receiving stacked coins on the upper surface thereof from the shutter 27 of the coin stacking mechanism 25 and moving them to a portion between the wrapping rollers 31, 31, 31.

Figure 3:
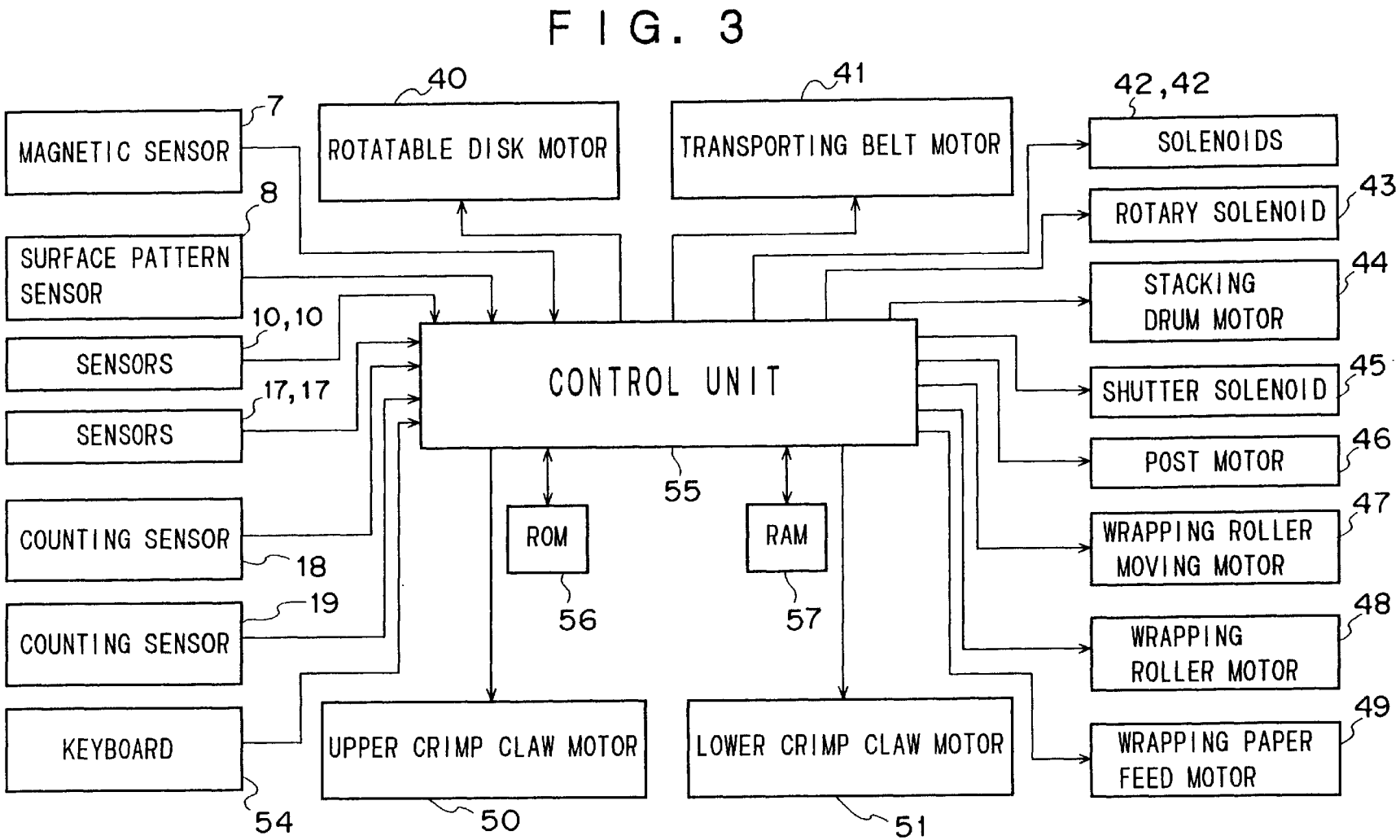
FIG. 3 is a block diagram of a detection system, a driving system, an input system and a control system of a coin handling machine provided with a coin sorting apparatus which is a preferred embodiment of the present invention.

FIG. 3 is a block diagram of a detection system, a driving system, an input system and a control system of a coin handling machine provided with a coin sorting apparatus which is a preferred embodiment of the present invention.

As shown in FIG. 3, the detection system of the coin handling machine includes the magnetic sensor 7 for detecting magnetic properties of coins, the surface pattern sensor 8 for detecting the pattern of the lower surfaces of coins, the pair of sensors 10, 10 for detecting the following coin to be stopped, the pair of sensors 17, 17 for detecting a coin to be led to either the coin selecting passage 11 or the coin collecting passage 12, the counting sensor 18 for counting the number of coins fed into the coin selecting passage 11, and the counting sensor 19 for counting the number of coins fed into the coin collecting passage 12.

As also shown in FIG. 3, the driving system of the coin handling machine includes a rotatable disk motor 40 for rotating the rotatable disk 1, a transporting belt motor 41 for driving the transporting belt 6, solenoids 42, 42 for rotating the pair of stopper members 9, 9, a rotary solenoid 43 for swinging the gate member 16, a stacking drum motor 44 for rotating the pair of stacking drums 26, 26, a shutter solenoid 45 for opening and closing the shutter 27, a post motor 46 for vertically moving the coin support post 36 for receiving stacked coins on the upper surface thereof from the shutter 27 and moving them to a portion between the wrapping rollers 31, 31, 31, a wrapping roller moving motor 47 for causing the wrapping rollers 31, 31, 31 to move close to each other and apart from each other, a wrapping roller motor 48 for rotating the wrapping rollers 31, 31, 31, a wrapping paper feed motor 49 for feeding wrapping paper from the wrapped roll 32 to a portion between the wrapping rollers 31, 31, 31, an upper crimp claw motor 50 for moving the upper crimp claw 33, and a lower crimp claw motor 51 for moving the lower crimp claw 34.

As also shown in FIG. 3, the input system of the coin handling machine includes a keyboard 54 through which a coin denomination to be sorted can be designated.

As shown in FIG. 3, the control system of the coin handling machine further includes a control unit 55 for controlling the operation of the coin handling machine, a ROM 56 for storing an operation program for the coin handling machine, reference magnetic data for each denomination of coins, reference surface pattern data for each denomination of coins and the like, and a RAM 57. Detection signals from the magnetic sensor 7, the surface pattern sensor 8, the pair of sensors 10, 10, the pair of sensors 17, 17, the counting sensor 18 and the counting sensor 19 are input to the control unit 55 and drive signals are output from the control unit 55 to the rotatable disk motor 40, the transporting belt motor 41, the solenoids 42, 42 and the rotary solenoid 43. When a first drive signal is output from the control unit 55 to the rotary solenoid 43, the rotary solenoid 43 swings the gate member 16 so that a coin can be led into the coin selecting passage 11 and, on the other hand, when a second drive signal is output from the control unit 55 to the rotary solenoid 43, the rotary solenoid 43 swings the gate member 16 so that a coin can be led into the coin collecting passage 12.

The thus constituted coin sorting apparatus of the coin handling machine according to a preferred embodiment of the present invention sorts coins having a denomination specified by an operator.

The coin denomination to be sorted is first input by the operator through the keyboard 54. The input signal is fed to the control unit 55 and the control unit 55 stores the denomination of coins to be sorted in the RAM 57.

When the operator inputs a start signal through the keyboard 54, the control unit 55 outputs a drive signal to the rotatable disk motor 40, thereby causing it to rotate the rotatable disk 1 and outputs a drive signal to the stacking drum motor 44, thereby causing it to rotate the pair of stacking drums 26, 26. The control unit 55 further outputs a drive signal to the post motor 46, thereby causing it to move the coin support post 36 upward to the waiting position thereof below the shutter 27.

Coins deposited from a coin depositing section (not shown) into the coin handling machine are conveyed by a transporting belt (not shown) and fed onto the rotatable disk 1. The coins fed onto the rotatable disk 1 are guided by centrifugal force produced by the rotation of the rotatable disk 1 to the opening 2 along the annular guide member (not shown) formed on the periphery of the rotatable disk 1.

Since a slot (not shown ) having greater than the thickness of the thickest coin among coins to be handled and less than double the thickness of the thinnest coin to be handled is formed at the opening 2, coins are fed into the coin sorting passage 3 connected to the opening 2 one by one.

Coins fed into the coin sorting passage 3 are conveyed by the transporting belt 6 in the coin sorting passage 3 while being pressed by the transporting belt 6 onto the upper surface of the coin sorting passage 3 and the magnetic properties of the coins are detected by the magnetic sensor 7, whereby a detection signal is output to the control unit 55.

The control unit 55 reads reference magnetic data for each denomination of coins from the ROM 56 and compares them with the magnetic data of the coin detected by the magnetic sensor 7, thereby temporarily determining the denomination of the coin and storing it in the RAM 57.

The coin is further fed downstream by the transporting belt 6 in the coin sorting passage 3 and the pattern of the lower surface thereof is detected by the surface pattern sensor 8, whereby a pattern detection signal is output to the control unit 55.

The control unit 55 reads the denomination of the coin temporarily determined based on the results of detection made by the magnetic sensor 7 and stored in the RAM 57. The control unit 55 then reads reference surface pattern data of the obverse surface and the reverse surface of the coin of the temporarily determined denomination from the ROM 56 and compares them with the pattern data of the lower surface of the coin detected by the surface pattern sensor 8.

When the pattern data of the lower surface of the coin does not coincide with either set of reference surface pattern data, the control unit 55 discriminates that the coin is an unacceptable coin and writes in the RAM 57 the result of discrimination that the coin should not be sorted.

To the contrary, when the pattern data of the lower surface of the coin coincide with one set of the reference surface pattern data, the control unit 55 discriminates that the denomination of the coin coincides with the denomination temporarily determined based on the results of detection made by the magnetic sensor 7 and stored in the RAM 57 and determines the denomination of the coin. The control unit 55 further discriminates whether or not the thus determined denomination coincides with the denomination of coins to be sorted which was specified by the operator and has been stored in the RAM 57.

When the denomination of the coin coincides with the denomination of coins to be sorted which was specified by the operator and has been stored in the RAM 57, the control unit 55 writes in the RAM 57 the result of discrimination that the coin should be sorted. On the other hand, when the denomination of the coin does not coincide with the denomination of coins to be sorted which was specified by the operator and has been stored in the RAM 57, the control unit 55 writes in the RAM 57 the result of discrimination that the coin should not be sorted.

The coin is fed further downstream in the coin sorting passage 3 by the transporting belt 6 and when the pair of sensors 17, 17 detects the coin and outputs a detection signal to the control unit 55, the control unit 55 outputs the first drive signal to the rotary solenoid 43 in the case where it has been discriminated that the coin should be sorted. To the contrary, in the case where it has been discriminated that the coin should not be sorted, the control unit 55 outputs the second drive signal to the rotary solenoid 43.

When the rotary solenoid 43 receives the first drive signal from the control unit 55, it swings the gate member 16 about the vertical shaft 15 to the first sorting position as indicated by the solid line in FIG. 1 so as to cross a plane which is parallel to the longitudinal direction of the coin sorting passage 3 and include the vertical shaft 15 so that the coin collecting passage 12 is closed, thereby leading the coin into the coin selecting passage 11.

To the contrary, when the rotary solenoid 43 receives the second drive signal from the control unit 55, it swings the gate member 16 about the vertical shaft 15 to a second sorting position as indicated by the broken line in FIG. 1 so as to cross a plane which is parallel to the longitudinal direction of the coin sorting passage 3 and includes the vertical shaft 15 so that the coin selecting passage 11 is closed, thereby leading the coin into the coin collecting passage 12.

The coin led into the coin selecting passage 11 is counted by the counting sensor 18 and fed into the selected coin chute 13 after output of a count signal to the control unit 55.

As well known in the art, the coin fed into the coin sorting chute 13 is stacked between the pair of stacking drums 26, 26 as the pair of stacking drums 26, 26 rotate.

On the other hand, the coin led into the coin collecting passage 12 is counted by the counting sensor 19 and fed into the coin collecting chute 14 after output of a count signal to the control unit 55.

Upon receiving the count signal from the counting sensor 18, the control unit 55 updates the counted number of sorted coins by increasing the count stored in the RAM 57 by one. Upon receiving the count signal from the counting sensor 19, on the other hand, the control unit 55 updates the counted number of unsorted coins by increasing the count stored in the RAM 57 by one.

Thus, when the counted number of sorted coins stored in the RAM 57 becomes equal to the number of coins to be wrapped in one wrapping coin roll, the control unit 55 outputs a drive signal to the pair of solenoids 42, 42 in response to input of a following coin detection signal from the pair of sensors 10, 10. When the pair of solenoids 42, 42 receives the drive signal, each rotates the associated stopper member 9 about the longitudinal shaft thereof so that the cylindrical side surface portion thereof projects into the coin sorting passage 3.

As a result, the following coin being conveyed in the coin sorting passage 3 is prevented by the pair of stopper members 9, 9 from being conveyed downstream of the stopper members 9, 9, thereby preventing coins whose number exceeds a predetermined number of coins to be wrapped in one wrapped coin roll from being fed into the coin selecting passage 11.

Therefore, coins whose number is equal to a predetermined number of coins to be wrapped in one wrapped coin roll are stacked between the pair of stacking drums 26, 26 and stacked coins are fed onto the shutter 27.

When the stacked coins have been placed on the shutter 27, the control unit 55 outputs a drive signal to the shutter solenoid 45 to open the shutter 27, thereby delivering the coins placed on the shutter 27 to the upper surface of the coin support post 36 located at the waiting position thereof immediately below the shutter 27.

The control unit 55 then outputs a drive signal to the post motor 46 to lower the coin support post 36, thereby positioning the stacked coins at the wrapping position thereof between the wrapping rollers 31, 31, 31.

As well known in the art, the control unit 55 then outputs a drive signal to the wrapping roller moving motor 47 to move the wrapping rollers 31, 31, 31 toward one another, thereby causing them to hold the stacked coins therebetween. The control unit 55 further outputs drive signals to the wrapping paper feed motor 49 and the wrapping roller motor 48, thereby winding the wrapping paper around the stacked coins and wrapping the stacked coins.

When the stacked coins have been wrapped with the wrapping paper, the control unit 55 outputs drive signals to the upper crimp claw motor 50 and the lower crimp claw motor 51, thereby causing the upper crimp claw 33 and the lower crimp claw 34 to crimp the upper and lower end portions of the wrapping paper wound around the stacked coins to produce a wrapped coin roll.

According to the above described embodiment, coins to be sorted are prevented from advancing into the coin collecting passage 12 by the gate member 16 swung to the first sorting position and, on the other hand, coins other than those to be sorted are prevented from advancing into the coin selecting passage 11 by the gate member 16 swung to the second sorting position. Therefore, it is possible to shorten the length of the coin sorting passage 3 in comparison with a conventional coin sorting apparatus in which coins are sorted by freely dropping coins other than those to be sorted into a coin sorting opening. Moreover, even when the conveying speed of coins is increased for improving coin handling efficiency, it is still possible to provide a compact coin sorting apparatus for a coin handling machine, because there is no need to excessively increase the length of the coin sorting passage 3.

Further, according to the above described embodiment, the gate member 16 is mounted on the vertical shaft in the vicinity of the end portion thereof and is designed to be swung about the vertical shaft 15 over 90 degrees so as to cross a plane which is parallel to the longitudinal direction of the coin sorting passage 3 and includes the vertical shaft 15. Moreover, when a coin is to be led into the coin selecting passage 11, the gate member 16 is swung to the first sorting position so as to close not less than 70% of the coin collecting passage 12 in the widthwise direction thereof and when a coin is to be led into the coin collecting passage 12, the gate member 16 is swung to the second sorting position so as to close not less than 70% of the coin selecting passage 11 in the widthwise direction thereof Therefore, even if the actuation of the gate member 16 is delayed for some reason and the gate member 16 is not completely swung to the first sorting position or the second sorting position, it is possible to effectively prevent a coin from advancing into the coin collecting passage 12 or the coin selecting passage 11, whereby it is possible to markedly shorten the length of the coin sorting passage 3 and to make the coin sorting apparatus 20 compact in comparison with a conventional coin sorting apparatus in which coins are sorted by freely dropping coins other than those to be sorted into a coin sorting opening.

Figure 4:
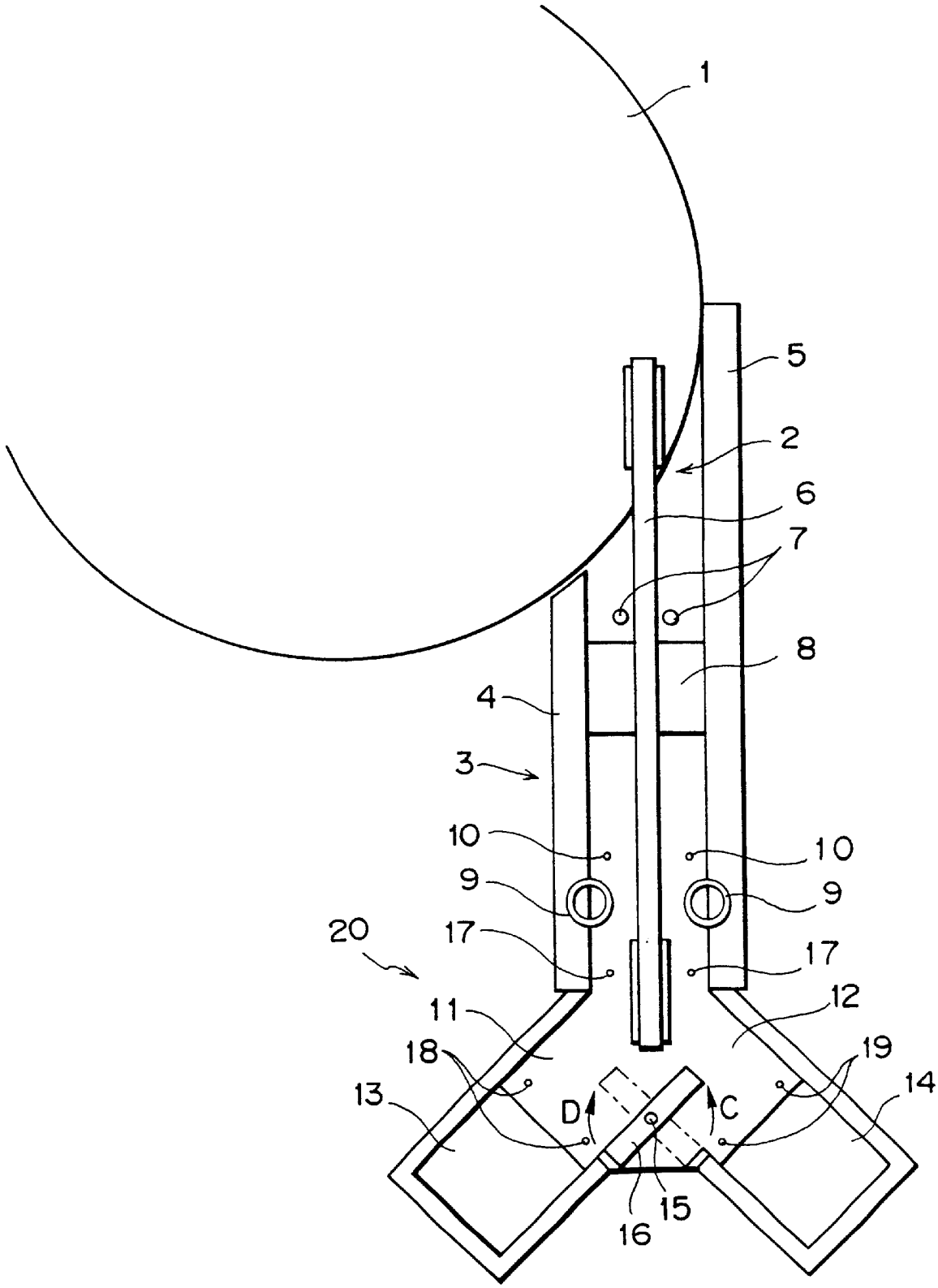
FIG. 4 is a schematic plan view showing a coin handling machine provided with a coin sorting apparatus which is another preferred embodiment of the present invention.

FIG. 4 is a schematic plan view showing a coin handling machine provided with a coin sorting apparatus which is another preferred embodiment of the present invention.

As shown in FIG. 4, in the coin sorting apparatus 20 according to this embodiment, a rod-like gate member 16 is mounted on the vertical shaft 15 at the substantially central portion thereof and is swingable so as to cross a plane which is perpendicular to the longitudinal direction of the coin sorting passage 3 and includes the vertical shaft 15. When a coin is to be led into the coin selecting passage 11, the gate member 16 is swung in the direction indicated by an arrow C in FIG. 4 so as to cross the plane which is perpendicular to the longitudinal direction of the coin sorting passage 3 and includes the vertical shaft 15, namely, from the downstream side of the coin collecting passage 12 toward the upstream side thereof and moved to a first sorting position where it closes not less than 60% of the coin collecting passage 12 in the widthwise direction although FIG. 4 is not exactly prepared. On the other hand, when a coin is to be led into the coin collecting passage 11, the gate member 16 is swung in the direction indicated by an arrow D in FIG. 4 so as to cross the plane which is perpendicular to the longitudinal direction of the coin sorting passage 3 and includes the vertical shaft 15, namely, from the downstream side of the coin selecting passage 12 toward the upstream side thereof and moved to a second sorting position where it closes not less than 60% of the coin selecting passage 12 in the widthwise direction. Except for the above feature, the coin sorting apparatus 20 according to this embodiment has the same configuration as that of the coin sorting apparatus 20 shown in FIG. 1.

According to the above described embodiment, unlike the gate member 16 shown in FIG. 1, the gate member 16 is constituted so that when a coin is to be led into the coin selecting passage 11, it is swung in the direction indicated by an arrow C in FIG. 4 so as to cross a plane which is perpendicular to the longitudinal direction of the coin sorting passage 3 and includes the vertical shaft 15, thereby forcibly preventing the coin from advancing into the coin collecting passage 12 and that when a coin is to be led into the coin collecting passage 12, it is swung in the direction indicated by an arrow D in FIG. 4 so as to cross the plane which is perpendicular to the longitudinal direction of the coin sorting passage 3 and includes the vertical shaft 15, thereby forcibly preventing the coin from advancing into the coin selecting passage 11. Therefore, even if the actuation of the gate member 16 is delayed for some reason and a coin erroneously advances into the passage into which the coin should not be led, the coin can be pushed back by the gate member 16. As a result, it is possible to markedly shorten the length of the coin sorting passage 3 and to make the coin sorting apparatus 20 compact in comparison with a conventional coin sorting apparatus in which coins are sorted by freely dropping coins other than those to be sorted into a coin sorting opening.

Further, according to the above described embodiment, unlike the gate member 16 shown in FIG. 1, since the gate member 16 is mounted on the vertical shaft 15 at the substantially central portion thereof, the swing stroke of the gate member 16 is small. Therefore, since the gate member 16 can be quickly moved to the first sorting position or the second sorting position, it is possible to markedly shorten the length of the coin sorting passage 3 and to make the coin sorting apparatus 20 compact in comparison with a conventional coin sorting apparatus in which coins are sorted by freely dropping coins other than those to be sorted into a coin sorting opening.

Figure 5:
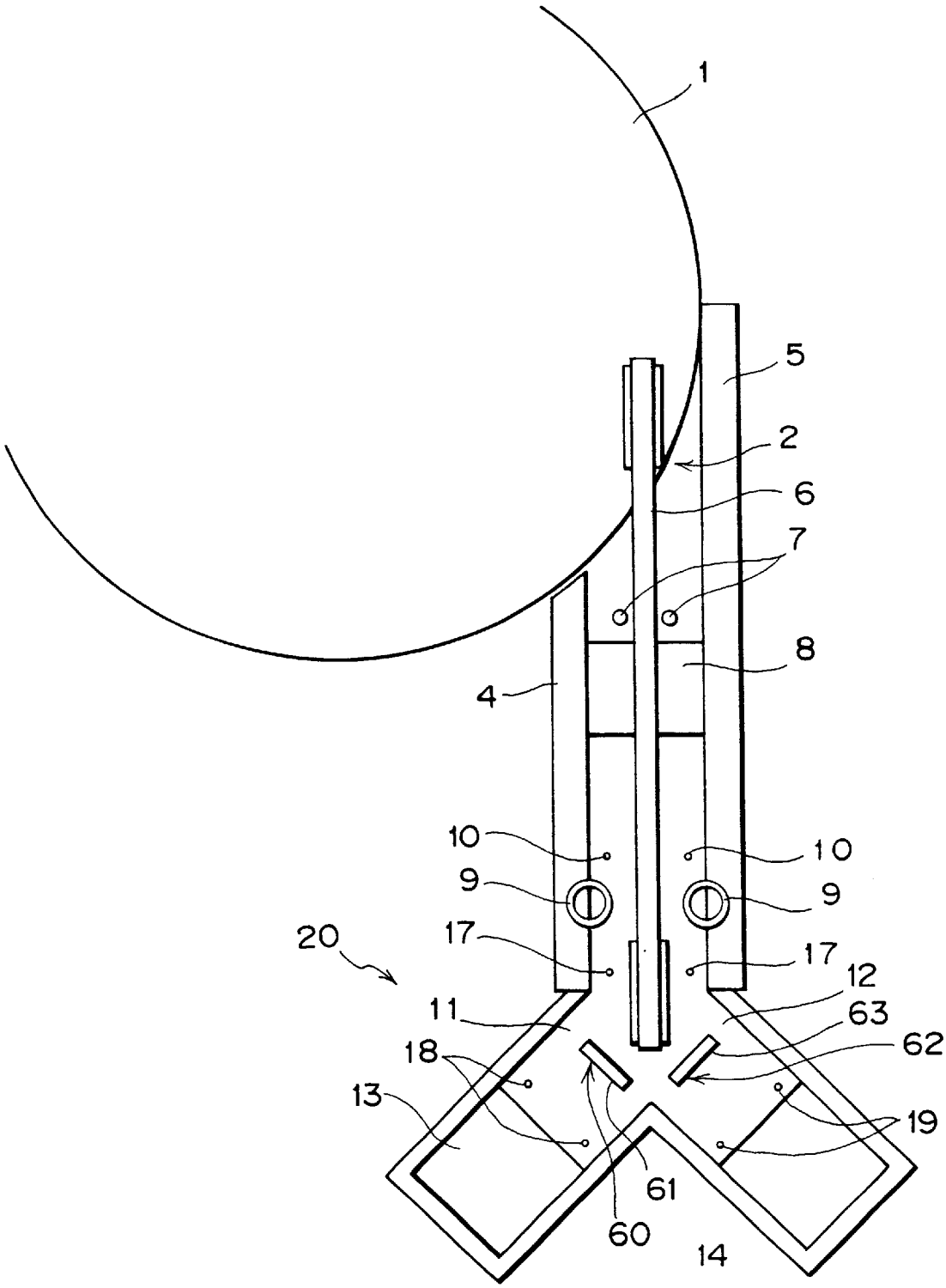
FIG. 5 is a schematic plan view showing a coin handling machine provided with a coin sorting apparatus which is a further preferred embodiment of the present invention.

FIG. 5 is a schematic plan view showing a coin handling machine provided with a coin sorting apparatus which is a further preferred embodiment of the present invention.

As shown in FIG. 5, in this embodiment, an opening 60 is formed at an inlet portion of the coin selecting passage 11 and a plate-like gate member 61 is provided so that it can project into the coin selecting passage 11 from the below and retract below the coin selecting passage 11 through the opening 60. Further, in this embodiment, an opening 62 is formed at an inlet portion of the coin collecting passage 12 and a plate-like gate member 63 is provided so that it can project into the coin collecting passage 12 from the below and retract below the coin collecting passage 12 through the opening 62.

Figure 6:
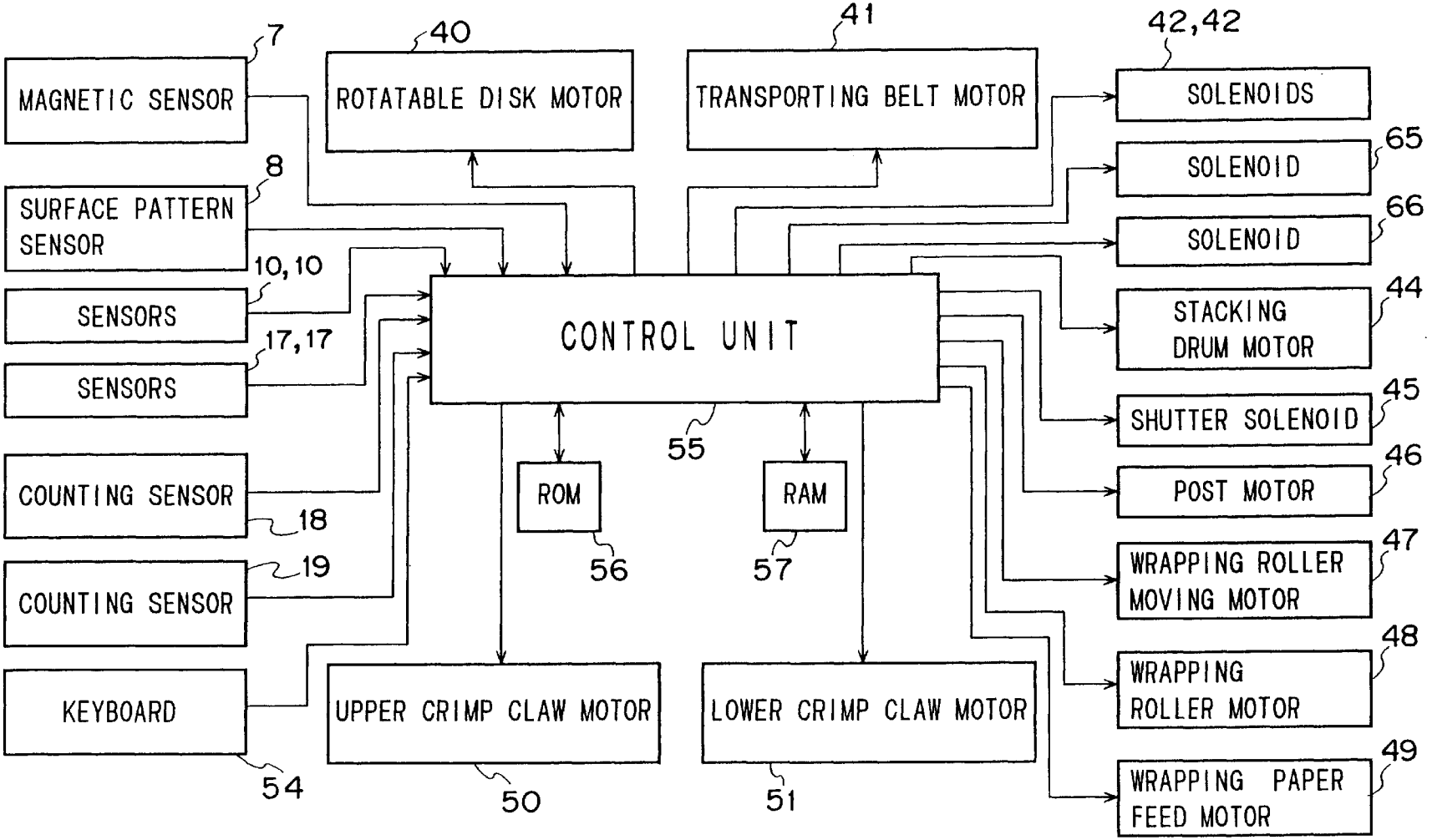
FIG. 6 is a block diagram of a detection system, a driving system, an input system and a control system of a coin handling machine provided with a coin sorting apparatus which is a further preferred embodiment of the present invention.

FIG. 6 is a block diagram of a detection system, a driving system, an input system and a control system of a coin handling machine provided with a coin sorting apparatus which is a further preferred embodiment of the present invention.

As shown in FIG. 6, the driving system of the coin handling machine according to this embodiment has the same configuration as that of the coin handling machine shown in FIG. 3 except that instead of the rotary solenoid 43 it includes a solenoid 65 for driving the gate member 61 and a solenoid 66 for driving the gate member 63. The control unit 55 outputs a drive signal to the solenoid 65, when the gate member 61 is to be projected into the coin selecting passage 11 and outputs a drive signal to the solenoid 66 when the gate member 63 is to be projected into the coin collecting passage 12.

In the thus constituted coin sorting apparatus 20 for the coin handling machine according to this embodiment, similarly to the previous embodiment shown in FIGS. 1 and 2, magnetic properties of a coin being conveyed in the coin sorting passage 3 are detected by the magnetic sensor 7 and the pattern of the lower surface of the coin is detected by the surface pattern sensor 8.

Similarly to the previous embodiment shown in FIGS. 1 and 2, the control unit 55 determines the denomination of a coin based on the magnetic properties of the coin detected by the magnetic sensor 7 and the pattern of the lower surface of the coin detected by the surface pattern sensor 8, discriminates whether or not the thus determined denomination of the coin coincides with the denomination of coins to be sorted specified by the operator and stored in the RAM 57, and writes the results of discrimination as to whether or not the coin is one to be sorted in the RAM 57.

When it has been written in the RAM 57 that a coin is one to be sorted, then, when the pair of sensors 17, 17 detect the coin and a detection signal is input to the control unit 55, the control unit 55 outputs a drive signal to the solenoid 66, thereby causing it to lift the plate-like gate member 63 retracted below the coin collecting passage 12 though the opening 62 formed at the inlet portion of the coin collecting passage 12 and project it into the coin collecting passage 12.

As a result, the coin is prevented by the plate-like gate member 63 from advancing into the coin collecting passage 12 and, on the other hand, the plate-like gate member 61 is held at the retracted position thereof below the coin selecting passage 11. Therefore, the coin is led into the coin selecting passage 11 and fed into the coin sorting chute 13.

The coin fed into the coin sorting chute 13 is stacked by the coin stacking mechanism 25 similarly to the previous embodiment. When a predetermined number of coins have been stacked, the stacked coins are fed to the coin wrapping mechanism 30 and wrapped by the coin wrapping mechanism 30, thereby producing a wrapped coin roll.

To the contrary, when it has been written in the RAM 57 that a coin should not be sorted, then, when, the pair of sensors 17, 17 detect the coin and a detection signal is input to the control unit 55, the control unit 55 outputs a drive signal to the solenoid 65, thereby causing it to lift the plate-like gate member 61 retracted below the coin selecting passage 11 though the opening 60 formed at the inlet portion of the coin selecting passage 11 and project it into the coin selecting passage 11.

As a result, the coin is prevented by the plate-like gate member 61 from advancing into the coin selecting passage 11 and, on the other hand, the plate-like gate member 63 is held at the retracted position thereof below the coin collecting passage 12. Therefore, the coin is led into the coin collecting passage 12 and fed into the coin collecting chute 14, thereby being collected.

According to the above described embodiment, coins to be sorted are prevented from advancing into the coin collecting passage 12 by driving the solenoid 66 and projecting the gate member 63 from the below through the opening 62 formed at the inlet portion of the coin collecting passage 12 into the coin collecting passage 12, whereby the coins to be sorted are forcibly led into the coin selecting passage 11. On the other hand, coins other than those to be sorted are prevented from advancing into the coin selecting passage 11 by driving the solenoid 65 and projecting the gate member 61 from the below through the opening 60 formed at the inlet portion of the coin selecting passage 11 into the coin selecting passage 11, whereby the coins to be sorted are forcibly led into the coin collecting passage 12. As a consequence, it is possible to markedly shorten the length of the coin sorting passage 3 in comparison with a conventional coin sorting apparatus in which coins are sorted by freely dropping coins other than those to be sorted into a coin sorting opening and even when the conveying speed of coins is increased for improving a coin handling efficiency, since it is unnecessary to excessively increase the length of the coin sorting passage 3, it is possible to provide a compact coin sorting apparatus for a coin handling machine.

The present invention has thus been shown and described with reference to specific embodiments. However, it should be noted that the present invention is in no way limited to the details of the described arrangements but changes and modifications may be made without departing from the scope of the appended claims.

For example, in the above described embodiments, the coin handling machine is provided with the coin stacking mechanism 25, the coin wrapping mechanism 30 and the crimping mechanism 35 below the coin sorting chute 13 and is constituted so as to wrap coins of the denomination specified by the operator and produce a wrapped coin roll including a predetermined number of coins. However, the coin sorting apparatus according to the present invention can also be applied to a coin handling machine which is not equipped with a coin stacking mechanism 25, a coin wrapping mechanism 30 and a crimping mechanism 35 and exclusively counts and sorts coins of the denomination specified by the operator.

Further, in the above described embodiments, although the pair of stopper members 9, 9 and the pair of sensors 10, 10 are provided in the coin sorting passage 3 so that coins whose number exceeds a predetermined number of coins to be wrapped in one wrapped coin roll are prevented from being fed into the coin selecting passage 11, it is not absolutely necessary to provide a pair of stopper members 9, 9 and a pair of sensors 10, 10 in the case where the coin sorting apparatus according to the present invention is applied to a coin handling machine which is not equipped with a coin stacking mechanism 25, a coin wrapping mechanism 30 and a crimping mechanism 35 and exclusively counts and sorts coins of the denomination specified by the operator.

Moreover, in the above described embodiments, although the counting sensor 19 is provided for counting the number of coins fed into the coin collecting passage 12, it is not absolutely necessary to provide a counting sensor 19 for counting the number of coins fed into the coin collecting passage 12.

Further, in the embodiment shown in FIGS. 1 to 3, the rod-like gate member 16 is constituted so that when a coin is to be led into the coin selecting passage 11, it is swung to the first sorting position so as to close not less than 70% of the coin collecting passage 12 in the widthwise direction thereof and that when a coin is to be led into the coin collecting passage 12, it is swung to the second sorting position so as to close not less than 70% of the coin selecting passage 11 in the widthwise direction thereof However, it is sufficient for the gate member 16 to prevent a coin from advancing into the coin collecting passage 12 or the coin selecting passage 11 in accordance with the results of the discrimination made by the control unit 55, thereby leading the coin into the coin selecting passage 11 or the coin collecting passage 12, and it is not absolutely necessary to constitute the gate member 16 so as to close not less than 70% of the coin collecting passage 12 or the coin selecting passage 11 in the widthwise direction thereof.

Moreover, in the embodiment shown in FIG. 4, the rod-like gate member 16 is constituted so that when a coin is to be led into the coin selecting passage 11, it is swung to the first sorting position so as to close not less than 60% of the coin collecting passage 12 in the widthwise direction thereof and that when a coin is to be led into the coin collecting passage 12, it is swung to the second sorting position so as to close not less than 60% of the coin selecting passage 11 in the widthwise direction thereof However, it is sufficient for the gate member 16 to prevent a coin from advancing into the coin collecting passage 12 or the coin selecting passage 11 in accordance with the results of the discrimination made by the control unit 55, thereby leading the coin into the coin selecting passage 11 or the coin collecting passage 12, and it is not absolutely necessary to constitute the gate member 16 so as to close not less than 60% of the coin collecting passage 12 or the coin selecting passage 11 in the widthwise direction thereof.

Further, in the embodiments shown in FIGS. 1 to 3 and FIG. 4, although the rod-like gate member 16 is employed, it is not absolutely necessary to employ a rod-like gate member 16 but it is possible to employ a gate member having any shape which can prevent a coin from advancing into the coin collecting passage 12 or the coin selecting passage Furthermore, although in the embodiment shown in FIGS. 5 and 6, when a coin is to be led into the coin selecting passage 11, the plate-like gate member 61 is retracted below the coin selecting passage 11 and when a coin is to be led into the coin collecting passage 12, the plate-like gate member 63 is retracted below the coin collecting passage 12. However, the plate-like gate member 61 may be constituted so that when a coin is to be led into the coin selecting passage 11, it is located at a position where the upper end surface thereof is flush with the upper surface of the coin selecting passage 11 or a position below the position where the upper end surface thereof is flush with the upper surface of the coin selecting passage 11 and the plate-like gate member 63 may be constituted so that when a coin is to be led into the coin collecting passage 12, it is located at a position where the upper end surface thereof is flush with the upper surface of the coin collecting passage 12 or a position below the position where the upper end surface thereof flushes with the upper surface of the coin collecting passage 12. Therefore, it is not absolutely necessary to locate the plate-like gate member 61 below the coin selecting passage 11 when a coin is to be led into the coin selecting passage 11 and to locate the plate-like gate member 63 below the coin collecting passage 12 when a coin is to be led into the coin collecting passage 12.

Moreover, although the plate-like gate member 61 and the platelike gate member 63 are employed in the embodiment shown in FIGS. 5 and 6, it is not absolutely necessary to employ plate-like gate members 61 and 63 but it is possible to employ a gate member having any shape which can prevent a coin from advancing into the coin collecting passage 12 or the coin selecting passage 11.

Further, in the embodiment shown in FIGS. 5 and 6, when a coin is to be led into the coin selecting passage 11, the solenoid 66 is driven, thereby projecting the plate-like gate member 63 into the coin collecting passage 12 and, on the other hand, when a coin is to be led into the coin collecting passage 12, the solenoid 65 is driven, thereby projecting the plate-like gate member 61 into the coin selecting passage 11, and the gate member 61 and the gate member 63 are driven by independent solenoids 65 and 66. However, it is possible to mechanically connect the gate member 61 and the gate member 63 using a link mechanism or the like so that when the gate member 61 is projecting into the coin selecting passage 11, the gate member 63 is located below the coin collecting passage 12 and that when the gate member 63 is projecting into the coin collecting passage 12, the gate member 61 is located below the coin selecting passage 11, and to drive the gate member 61 and the gate member 63 using a single solenoid.

Furthermore, the gate member 16 is driven by the rotary solenoid 43 in the embodiment shown in FIGS. 1 to 4 and the gate member 61 and the gate member 63 are driven by the solenoid 65 and the solenoid 66 in the embodiment shown in FIGS. 5 and 6. However, instead of solenoids, the gate member 16, the gate member 61 and the gate member 63 may be driven by drive means other than a solenoid such as a motor.

Moreover, in the above described embodiments, although the spacing between the pair of guide members 4, 5, namely, the width of the coin sorting passage 3 is adjusted in order to simultaneously handle coins of various denominations so that largest coins among coins to be handled can be conveyed, it is possible to adjust the gate member 16 driven by the rotary solenoid 43 so as to be suitable for handling coins of a specific denomination and wrap coins of the specific denomination, or count coins of the specific denomination and sort and collect unacceptable coins. In this case, it is possible to provide means for automatically adjusting the spacing between the pair of guide members 4, 5 based on the denomination of coins to be handled input through the keyboard 54 by the operator.

Further, although in the above described embodiments, although the guide member 5 is slidable with respect to the facing guide member 5 and the width of the coin sorting passage 3 can be adjusted by sliding the guide member 5 in accordance with the denomination of coins to be handled, both of the pair of guide members 4, 5 may be constituted so as to be slidable with respect to the other.

According to the present invention, it is possible to provide a compact coin sorting apparatus for a coin handling machine.

According to the present invention, it is further possible to provide a coin sorting apparatus for a coin handling machine, which can improve coin handling efficiency without size increase.

According to the present invention, it is further possible to provide a coin handling machine which can improve coin handling efficiency without size increase.

What is claimed is:

1. A coin sorting apparatus for a coin handling machine including a coin sorting passage extending substantially one-dimensionally and having transporting belt means for conveying coins, and denomination discriminating means provided in the coin sorting passage for discriminating the denominations of coins, wherein the coin sorting passage is bifurcated at a downstream portion thereof into a coin selecting passage for leading coins to be sorted therethrough and a coin collecting passage for leading coins other than those to be sorted therethrough, the coin sorting apparatus further including gate means provided at the portion where the coin sorting passage is bifurcated into the coin selecting passage and the coin collecting passage for selectively leading coins into the coin selecting passage or the coin collecting passage in accordance with results of discrimination made by the denomination discriminating means.

2. A coin sorting apparatus in accordance with claim 1 wherein the gate means is constituted so that when coins are to be led into the coin selecting passage, the gate means prevents coins from advancing into the coin collecting passage and that when coins are to be led into the coin collecting passage, it prevents coins from advancing into the coin selecting passage.

3. A coin sorting apparatus in accordance with claim 2 wherein the gate means is formed by a rod member which is mounted on a shaft provided at the bifurcated portion so as to be swingable about the shaft and is constituted so that when coins are to be led into the coin selecting passage, it is swung into the coin collecting passage, thereby preventing the coins from advancing into the coin collecting passage and that when coins are to be led into the coin collecting passage, it is swung in the coin selecting passage, thereby preventing the coins from advancing into the coin selecting passage.

4. A coin sorting apparatus in accordance with claim 3 wherein the gate means is mounted on the shaft in the vicinity of an end portion thereof and is swingable from an upstream side of the coin collecting passage and the coin selecting passage toward a lower side thereof so as to cross a plane which is parallel to a longitudinal direction of the coin sorting passage and includes the shaft.

5. A coin sorting apparatus in accordance with claim 3 wherein the gate means is mounted on the shaft at a substantially central portion thereof and is swingable from an upstream side of the coin collecting passage and the coin selecting passage toward a lower side thereof so as to cross a plane which is parallel to a longitudinal direction of the coin sorting passage and includes the shaft.

6. A coin sorting apparatus in accordance with claim 2 which further includes a first opening provided at an inlet portion of the coin collecting passage and a second opening provided at an inlet portion of the coin selecting passage and the gate means includes a first gate member adapted to project into the coin collecting passage through the first opening and retract below a position where it is flush with an upper surface of the coin collecting passage and a second gate member adapted to project into the coin selecting passage through the second opening and retract below a position where it is flush with an upper surface of the coin selecting passage.

7. A coin sorting apparatus in accordance with claim 6 wherein each of the first gate member and the second gate member is formed by a plate-like member.

8. A coin sorting apparatus in accordance with claim 1 wherein the gate means is formed by a rod member which is mounted on a shaft provided at the bifurcated portion so as to be swingable about the shaft and is constituted so that when coins are to be led into the coin selecting passage, it is swung into the coin collecting passage, thereby preventing the coins from advancing into the coin collecting passage and that when coins are to be led into the coin collecting passage, it is swung in the coin selecting passage, thereby preventing the coins from advancing into the coin selecting passage.

9. A coin sorting apparatus in accordance with claim 8 wherein the gate means is mounted on the shaft in the vicinity of an end portion thereof and is swingable from an upstream side of the coin collecting passage and the coin selecting passage toward a lower side thereof so as to cross a plane which is parallel to a longitudinal direction of the coin sorting passage and includes the shaft.

10. A coin sorting apparatus in accordance with claim 8 wherein the gate means is mounted on the shaft at a substantially central portion thereof and is swingable from an upstream side of the coin collecting passage and the coin selecting passage toward a lower side thereof so as to cross a plane which is parallel to a longitudinal direction of the coin sorting passage and includes the shaft.

11. A coin sorting apparatus in accordance with claim 1 which further includes a first opening provided at an inlet portion of the coin collecting passage and a second opening provided at an inlet portion of the coin selecting passage and the gate means includes a first gate member adapted to project into the coin collecting passage through the first opening and retract below a position where it is flush with an upper surface of the coin collecting passage and a second gate member adapted to project into the coin selecting passage through the second opening and retract below a position where it is flush with an upper surface of the coin selecting passage.

12. A coin sorting apparatus in accordance with claim 11 wherein each of the first gate member and the second gate member is formed by a plate-like member.

13. A coin handling machine provided with a coin sorting apparatus including a coin sorting passage extending substantially one-dimensionally and having transporting belt means for conveying coins, and denomination discriminating means provided in the coin sorting passage for discriminating the denominations of coins, wherein the coin sorting passage is bifurcated at a downstream portion thereof into a coin selecting passage for leading coins to be sorted therethrough and a coin collecting passage for leading coins other than those to be sorted therethrough, the coin sorting apparatus further including gate means provided at the portion where the coin sorting passage is bifurcated into the coin selecting passage and the coin collecting passage for selectively leading coins into the coin selecting passage or the coin collecting passage in accordance with results of discrimination made by the denomination discriminating means.

14. A coin handling machine in accordance with claim 13 wherein the gate means is constituted so that when coins are to be led into the coin selecting passage, the gate means prevents coins from advancing into the coin collecting passage and that when coins are to be led into the coin collecting passage, it prevents coins from advancing into the coin selecting passage.

15. A coin handling machine in accordance with claim 14 which further includes a coin sorting chute connected to the coin selecting passage and a coin collecting chute connected to the coin collecting passage.

16. A coin handling machine in accordance with claim 14 which further includes coin stacking means provided below a downstream portion of the coin selecting passage for stacking coins and coin wrapping means provided below the coin stacking means for wrapping the coins stacked by the coin stacking means.

17. A coin handling machine in accordance with claim 14 which further includes sensor means provided in the coin selecting passage for detecting coins.

18. A coin handling machine in accordance with claim 13 which further includes a coin sorting chute connected to the coin selecting passage and a coin collecting chute connected to the coin collecting passage.

19. A coin handling machine in accordance with claim 13 which further includes coin stacking means provided below a downstream portion of the coin selecting passage for stacking coins and coin wrapping means provided below the coin stacking means for wrapping the coins stacked by the coin stacking means.

20. A coin handling machine in accordance with claim 13 which further includes sensor means provided in the coin selecting passage for detecting coins.

* * * * *